US009733050B2

(12) United States Patent
Moberg

(10) Patent No.: US 9,733,050 B2
(45) Date of Patent: Aug. 15, 2017

(54) PROJECTILE ARRESTING DEVICE AND PROJECTILE ARRESTING ARRANGEMENT

(71) Applicant: Stapp International AB, Eskilstuna (SE)

(72) Inventor: Gerth Moberg, Eskilstuna (SE)

(73) Assignee: Stapp International AB, Eskilstuna (SE)

( * ) Notice: Subject to any disclaimer, the term of this patent is extended or adjusted under 35 U.S.C. 154(b) by 0 days.

(21) Appl. No.: 15/305,210

(22) PCT Filed: Apr. 17, 2015

(86) PCT No.: PCT/SE2015/050448
§ 371 (c)(1),
(2) Date: Oct. 19, 2016

(87) PCT Pub. No.: WO2015/163810
PCT Pub. Date: Oct. 29, 2015

(65) Prior Publication Data

US 2017/0045341 A1 Feb. 16, 2017

(30) Foreign Application Priority Data

Apr. 24, 2014 (SE) ..... 1450491

(51) Int. Cl.
*F41J 13/00* (2009.01)
*F41J 13/02* (2009.01)

(52) U.S. Cl.
CPC ..... *F41J 13/00* (2013.01); *F41J 13/02* (2013.01)

(58) Field of Classification Search
CPC ..... F41J 13/00; F41J 13/02
(Continued)

(56) References Cited

U.S. PATENT DOCUMENTS 1,363,677 A 12/1920 Serra
3,512,778 A 5/1970 Allen
(Continued)

FOREIGN PATENT DOCUMENTS

DE 2839509 A1 4/1980
DE 3734439 A1 4/1989
(Continued)

OTHER PUBLICATIONS

International Search Report completed Jul. 13, 2015 for International Application No. PCT/SE2015/050448.
(Continued)

*Primary Examiner* — Mark Graham
(74) *Attorney, Agent, or Firm* — Brinks Gilson & Lione

(57) ABSTRACT

The present invention relates to a projectile arresting device (1) comprising a foundation (3) constituting a floor (7) and a rear wall (5) of the projectile arresting device. It further comprises partition walls (9) extending in a direction substantially perpendicular to the rear wall (5), wherein the partition walls comprises a rear edge (10*a*) connected to the foundation (3), and a front edge (10*b*). Stopping materials (11) is arranged between the partition walls (9). A stopping material retaining layer (S) is arranged between the partition walls, and a pressure resistant wall (19) comprising a number of closely situated hollow sections (15) are connected to the front edges (10*b*) of the partition walls. The pressure resistant wall (19) further comprises a rear surface connected to the stopping material retaining layer (S) and a front surface. The front edge (10*b*) of each partition wall comprises a V-shaped profile of ballistic material, wherein a tip (12*a*) of the profile is adjacent to the pressure resistant wall. The invention also relates to a projectile arresting arrangement.

14 Claims, 4 Drawing Sheets

(58) Field of Classification Search
USPC ..... 273/403–410
See application file for complete search history.

(56) References Cited

U.S. PATENT DOCUMENTS

| | | | | | |
|---|---|---|---|---|---|
| 4,445,693 | A * | 5/1984 | Angwin | F41J 13/00 | 273/404 |
| 4,512,585 | A * | 4/1985 | Baravaglio | F41J 13/00 | 273/410 |
| 4,856,791 | A * | 8/1989 | McQuade | F41J 13/00 | 273/410 |
| 5,366,105 | A * | 11/1994 | Kerman | F41J 13/00 | 220/62.11 |
| 5,435,571 | A * | 7/1995 | Wojcinski | F41J 13/00 | 273/404 |
| 5,618,044 | A | 4/1997 | Bateman | | |
| 5,718,434 | A * | 2/1998 | Alward | F41J 13/00 | 273/410 |
| 6,173,956 | B1 | 1/2001 | O'Neal | | |
| 6,341,708 | B1 * | 1/2002 | Palley | B65D 88/14 | 206/3 |
| 6,722,195 | B2 * | 4/2004 | Duke | F41J 13/00 | 273/410 |
| 8,162,321 | B1 * | 4/2012 | Shank, Jr. | F41J 13/00 | 273/410 |
| 2002/0121741 | A1 * | 9/2002 | Malone | F41J 13/00 | 273/410 |
| 2006/0131813 | A1 | 6/2006 | Moberg | | |
| 2006/0202425 | A1 * | 9/2006 | Pulkrabek | F41J 3/0004 | 273/404 |
| 2012/0038110 | A1 * | 2/2012 | Priebe | F41J 13/00 | 273/410 |
| 2016/0116260 | A1 * | 4/2016 | Oh | F41J 13/00 | 273/410 |

FOREIGN PATENT DOCUMENTS

| | | | | |
|---|---|---|---|---|
| DE | 94 07 238 | U1 | 7/1994 | |
| DE | 20 2005 002 672 | U1 | 6/2005 | |
| EP | 0332273 | A1 | 9/1989 | |
| EP | 0 683 375 | A1 | 11/1995 | |
| EP | 1 990 599 | A1 | 11/2008 | |
| GB | 2042142 | A * | 9/1980 | F41J 13/00 |
| JP | 2002 318097 | A1 | 10/2002 | |
| JP | 2006 078109 | A | 3/2006 | |
| JP | 2006 343082 | A | 12/2006 | |
| SE | 1251210 | A1 | 5/2014 | |

OTHER PUBLICATIONS

Written Opinion completed Jul. 13, 2015 for International Application No. PCT/SE2015/050448.

* cited by examiner

PROJECTILE ARRESTING DEVICE AND PROJECTILE ARRESTING ARRANGEMENT

This application claims the benefit under 35 U.S.C. §371 of International Application No. PCT/SE2015/050448, filed Apr. 17, 2015, which claims the benefit of Swedish Patent Application No. 1450491-4, filed Apr. 24, 2014 which are incorporated by reference herein in their entirety.

TECHNICAL HELD

The present invention relates to a projectile arresting device according to the preamble of claim 1. The invention also relates to a projectile arresting arrangement according to the preamble of claim 13. The projectile arresting device and projectile arresting arrangement are intended to be installed on shooting ranges.

PRIOR ART

For practice and competition shooting with gunpowder driven projectiles at shooting ranges, shots are directed at target surfaces in the form of e.g. circle marked square targets or figure-like targets of various sizes and shapes. A projectile wresting element is usually situated behind the targets.

An arresting element for outdoor use is usually constituted of masses of earth or gravel excavated up to a longitudinal ridge or, as an option, the arresting element is a natural slope. The propagation of the arresting element is determined by the target area and the kind of specified security measures for the corresponding firearms and the type of gunfire. To avoid ricochets from the wresting material in e.g. embankments, these are supplemented with projectile arresting materials on the part of the arresting element exposed to gunfire. This material is carefully selected depending on the type of gunfire and stops the projectiles and retains them within the arresting element.

More advanced projectile arresting elements comprises a frame of walls surrounding a layer of granular material, with a front rubber layer. EP0683375 A1 discloses an absorption projectile arresting element of the type which is insertable within a container. All walls apart from the wall facing shooters are constituted of ballistic plates. The surface of the projectile arresting element facing shooters is constituted of a rubber cover. Granular material is arranged behind said cover. Means for resisting the pressure of the granular material is arranged between the granular material and the cover. These means include vertical elements of hardened steel or rubber. Alternatively, the resistance means comprises a plurality of blocks which are made of plastic material and have a very high ductility. The blocks may also be manufactured by the use of pressed and glued elastomeric granular material. A layer that allows the passage of the non-deformed projectiles is provided. Said layer does not break or permanently deform after the passage of the projectiles.

The projectile arresting element described in EP0683375 is intended for indoor use only. Therefore, the structure is not suitable for outdoor use. The height of the arresting element is too low for shooting outdoors due to the firing distances outdoors, in general, are longer than the firing distances indoors. A further disadvantage of the projectile arresting element disclosed in EP0683375 is that the means to resist the pressure of the granular material will tear and deform during penetration.

US2006/0131813 discloses an apparatus for installation at shooting ranges. The device has a housing, which housing has an L-shaped concrete plate, a resilient top layer and a flexible bottom layer. The bottom layer extends along an inclined bottom surface and over an upwardly protruding support member to a front side. The top layer is attached to the bottom layer at the front side to form a container. A non-liquid granular material is packed in the container. The inclined bottom surface is inclined at an angle in relation to a horizontal plane. The angle is less than an angle of repose of the granular material.

The device shown in US2006/0131813 is intended for outdoor use. It has the disadvantage that it is so big and heavy that it cannot be moved to another area. If installed, it must remain there. Moreover, the device has the disadvantage that the rubber front layer will break and deform during penetration of the projectiles. This is due to the massive rubber material that is pushed to the side and backwards by the penetrating projectile. The rubber front layer also tends to adopt a bulging shape after penetration.

Hence, there is a need for an improved projectile arresting element which overcomes the above disclosed disadvantages.

SUMMARY

The object of the present invention is to provide an inventive projectile arresting device where the previously mentioned problems are avoided.

This object is achieved by a projectile arresting device comprising a foundation frame forming a floor and a rear wall of the projectile arresting module, partition walls extending in a direction substantially perpendicular to the rear wall, the partition walls comprising a rear edge attached to the foundation and a front edge. The projectile arresting device further comprises stopping material arranged between the partition walls, a stopping material retaining layer arranged between the partition walls and a pressure resistant wall comprising a number of closely situated hollow sections connected to the front edges of the partition walls. The pressure resistant wall further comprises a rear surface connected to the stopping material retaining layer and a front surface. The front portion of the partition walls further comprises a V-shaped profile of ballistic material, wherein the tip of the profile is adjacent to the pressure resistant wall.

The projectile arresting device has the advantage that only the hollow sections which have a large number of penetrations need to be replaced during maintenance. The hollow sections which are more or less intact can remain.

Another advantage is that the row of hollow section is resistant to the load from the stopping material.

Yet another advantage is that projectiles that penetrate a hollow section expand through the stopping material so that the projectiles will be captured between the row of hollow sections and the rear wall.

Yet a further advantage of the present invention is that the hollow sections are not deformed by the penetrating projectiles. In contrast to a massive front layer, no material is pushed aside and backwards by the penetrating projectiles. Thus, even if the hollow sections receive many penetration holes, the hollow sections still maintain their rigidity.

Yet a further advantage of the present invention is that the projectile arresting device may be embodied as a module. By grouping at least two projectile arresting devices together any desired projectile arresting arrangement can be obtained. The projectile arresting arrangement is also flexible and can easily be rearranged into a different form or to another location.

Yet a further advantage of the present invention is that it is possible to use existing walls, floors and ceilings for assembly of a projectile arresting device or projectile arresting arrangement indoors. Existing walls and floors then constitutes the foundation for the projectile arresting device or the projectile arresting arrangement.

Yet a further advantage of the present invention is that projectiles that hit the V-shaped profile of the ballistic material is steered away from the partition walls and slowed down by the stopping material. This means that the projectiles cannot travel parallel to the partition walls without being slowed down.

According to another feature, a stopping material retaining layer of polymeric material is arranged between the partition walls which allow replacement of worn hollow sections while the stopping material can substantially remain in place in the projectile arresting device.

According to yet a further feature the tip of the V-shaped profile is provided with a wing of ballistic material whereupon polymeric sections can be arranged. The polymeric sections have the advantage that the mounting of the pressure resistant wall can be easily mounted in the device.

According to a further feature, the mechanical integrity of the partition walls, between roof and floor, can be met by the V-shaped steel profiles. This has the advantage that the partition walls may consist of profiles in polymeric material, ballistic plates or a combination of these. This makes the device flexible during installation and design.

According to another feature, the hollow sections are provided with a groove and a tongue for connecting the hollow profiles to each other. This has the advantage that there will be no gaps between the hollow sections. Hollow sections are also easy to install and remove.

According to another feature, the hollow sections are made of a polymeric material or a reinforced polymeric material. This has the effect that the penetrated plastic material and the hollow profiles will melt in the penetrated area due to the friction that occurs during the penetration of a projectile. This is advantageous as the hollow sections will not bend or deform by the penetrating projectiles, and the physical dimensions of the hollow section will remain intact, as the passage of the projectile through the partially melted plastic does not generate enough force to push the hollow section sideways or into the stopping material.

The hollow sections comprise a substantially longitudinal slab-shaped geometry. The hollow sections further comprise an internal structure divided into cells surrounded by outer walls. The hollow sections may be provided with a groove and a tongue that serves to connect the vertical hollow sections to each other and to prevent openings. According to another feature, the hollow sections have a cross section length of 30-150 mm and a cross section width of 100-400 mm, and more preferably a cross section length of 35-80 mm and a cross section width of 115-175 mm. This has the advantage that the hollow sections are sufficiently rigid to resist the pressure of the stopping material. At the same time, the hollow sections have relatively thin walls, resulting in lower material consumption and lower costs.

According to another embodiment preferably intended for outdoor installation, the projectile arresting device comprises a roof, which is protruding from the rear wall and covers an area in front of the projectile arresting device. The roof has the advantage that the projectile arresting device is protected against e.g. rain and snow. The roof also has the advantage that ricochets and misdirected shots can be stopped and captured up by the roof.

According to a further feature, the roof preferably intended for outdoor assembly, is attached to the foundation and between the partition walls. This has the advantage that the roof is sturdy and firm.

According to yet another feature, the roof preferably intended for outdoor assembly, comprises a roof bottom layer, made of a row of hollow sections, and a roof top layer. This has the advantage that projectiles that penetrates a hollow section will fracture when they hit the roof top layer. The parts ricochet, but are stopped by hollow sections as the projectile parts cannot escape through the entrance holes in the hollow sections.

According to yet a further feature the roof top layer is made of a ballistic plate. This has the advantage that the projectiles that penetrate a hollow profile cannot go further, through the roof.

According to a further feature there is a gap between the roof top layer and the roof bottom layer. This has the advantage that there will be room for the trapped projectiles.

According to yet a further feature, the roof comprises a manhole. This has the advantage that maintenance work and replacement of stopping material will be easier to perform.

According to another feature, a moisture barrier layer is arranged at the foundation. This has the advantage that less moisture penetrates into the stopping material and that the moisture that penetrates into the stopping material does not spill out through the foundation. This also results in a smaller environmental impact because the moisture in the stopping material due to condensation or leaks can leach lead and other harmful substances from the trapped projectiles and the leaching may impact on the surrounding environment in a negative way.

According to yet a further feature a perforated drainage pipe is arranged in connection to the low point of the moisture barrier layer. This has the advantage that existing moisture in the stopping material may be drained in a controlled manner which facilitates the disposal of any harmful substances.

According to another feature, a surface layer intended for target projection may be arranged on the pressure resistant wall. This has the advantage that different types of targets can conveniently be used for the device.

According to a further feature, the space between the roof bottom layer and the roof top layer is 50 mm-300 mm, and preferably 100 mm. The advantage of this distance is that there is enough space to handle the pressure that arises from the projectile and which hits the roof top layer, and also to reduce tearing at the back of the hollow sections caused by shrapnel.

According to yet a further feature the foundation is a standard ground support element. This has the advantage that the projectile arresting device will be economically advantageous and that the foundation is relatively small and can be arranged anywhere on the ground. The foundation can easily be moved to another position when so desired.

The object of the present invention is also achieved by a projectile arresting arrangement as defined in the introduction; the projectile arresting arrangement is characterized by the features of claim 13. This has the advantage that a shooting area can be protected in all directions without the need of any protective walls or similar devices. By grouping at least two projectile arresting devices together, any desired shape of a projectile arresting arrangement may be obtained.

The projectile arresting arrangement is also flexible and can be easily rearranged into another form or easily moved to another location.

BRIEF DESCRIPTION OF THE DRAWINGS

The present invention will now be described in detail with reference to the schematic drawings, where.

DETAILED DESCRIPTION

Figure 1A:
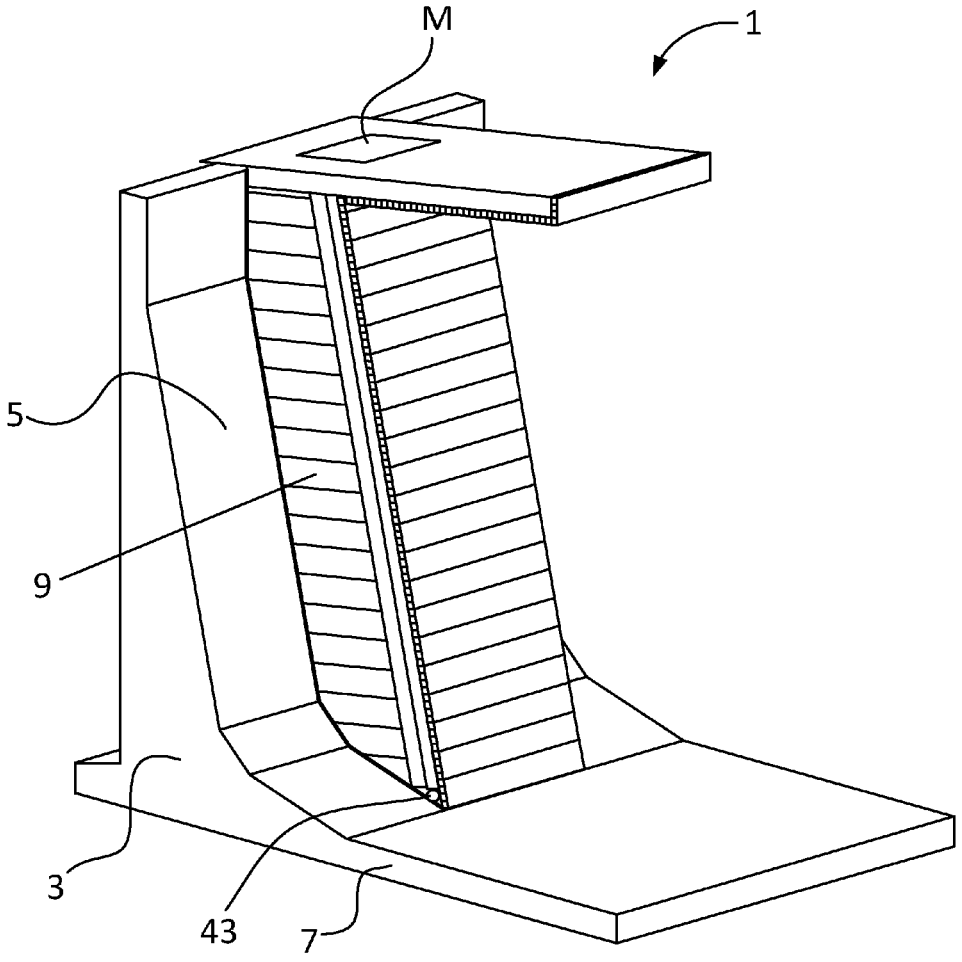
FIG. 1A shows a perspective view of a projectile arresting device according to an embodiment of the present invention.

Hereinafter, embodiments of the present invention will be described in detail with reference to the accompanying drawings relating to embodiments, wherein some details irrelevant are not shown in the drawings for clarity and for the sake of understanding the invention.

For clarity, the figures are not depicted to scale.

Reference numbers mentioned in the claims should not be viewed as limiting the scope protected by the claims and their sole function is to make claims easier to understand.

As will be realized, the invention can be modified in various obvious respects, all without departing from the scope of the appended claims. Accordingly, the drawings and description thereto should be viewed as illustrative in nature, and not restrictive.

The front side of the projectile arresting device is defined as the side which is facing towards the shooter and the rear side of the projectile arresting device is defined as the side opposite the front side.

Figure 1B:
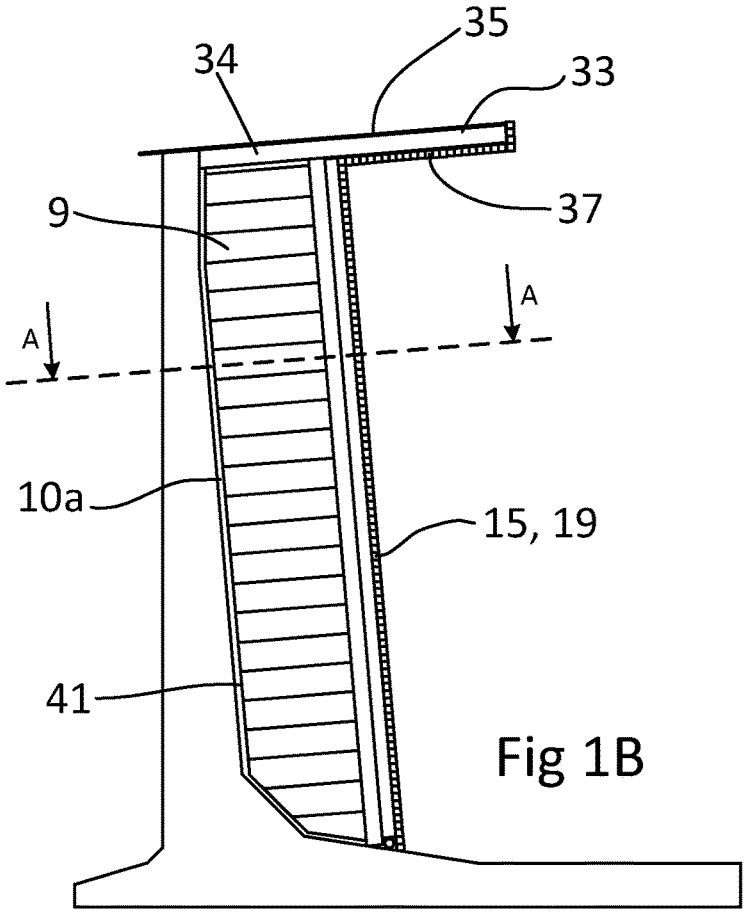
FIG. 1B shows a side view of a projectile arresting device according to an embodiment of the present invention.
Figure 1C:
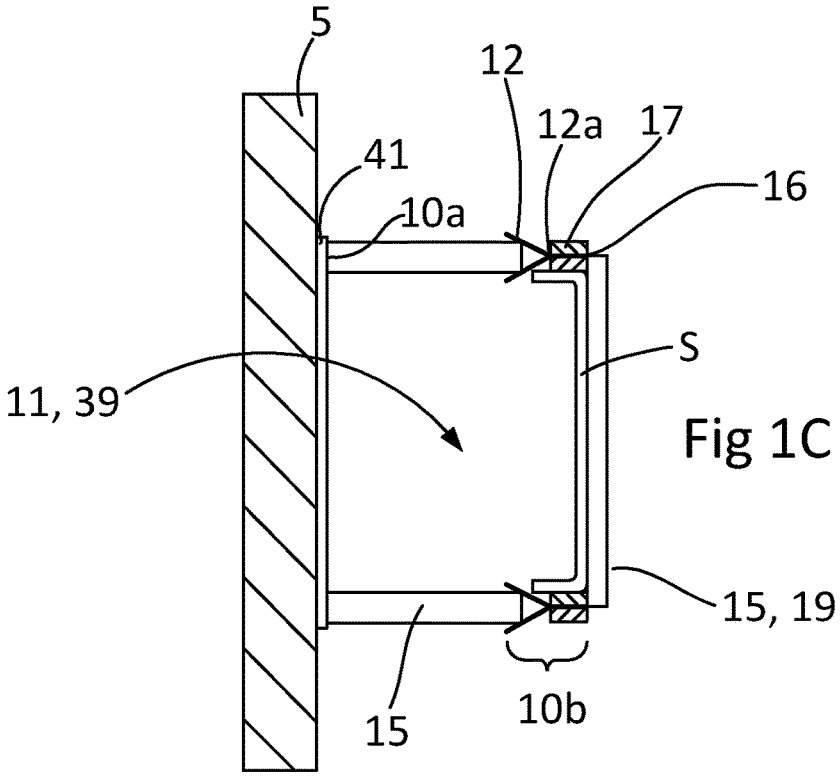
FIG. 1C shows a cross sectional view of the projectile arresting device of an embodiment, viewed from section A-A in FIG. 1B.

FIGS. 1A and 1B show a perspective view and a side view of a projectile arresting device 1 according to an embodiment of the present invention. FIG. 1C shows a cross sectional view of the projectile arresting device of the embodiment seen from section A-A in FIG. 1B. The projectile arresting device 1 comprises a foundation 3 made of concrete. The foundation 3 may be a standard ground support element such as premade concrete support wall unit in L- or T-shape for greater heights. The foundation 3 forms a rear wall 5 and a floor 7 of the projectile arresting device 1. The height of the projectile arresting device 1 may be between 0.6 m-8 m, and preferably between 1.2 m-5 m. Partition walls 9 are arranged to the foundation 3 and extends in the direction towards the shooter. The partition walls 9 comprise a rear edge 10*a*, which is connected to the foundation 3, and a front edge 10*b*. The distance between the walls may vary between 400 mm and 2400 mm, and preferably between 800 mm and 1200 mm. The partition walls 9 may have a width of about 150 mm-1500 mm, preferably 400 mm-1200 mm, the projectile arresting device 1 is also provided with a stopping material 11, wherein the function of the stopping material is to capture and absorb the projectiles. The stopping material 11 is preferably a polymeric or rubber granular material, but other materials capable of capturing and retaining the projectiles can also be used. The stopping material 11 is arranged between the partition walls 9.

The projectile arresting device 1 further comprises a pressure resistant wall 19. The pressure resistant wall 19 serves to resist the pressure of the stopping material 11 for keeping the stopping material 11 in place, and to prevent projectiles penetrating the projectile arresting device 1 from escaping. The pressure resistant wall 19 comprises a plurality of closely situated hollow sections 15. The projectile arresting device 1 further comprises a stopping material retaining layer S provided between the partition walls 9. The pressure resistant wall 19 is arranged to the front edges 10*b* of the partition walls. The stopping material retaining layer S serves to keep the stopping material 11 in place during maintenance of the projectile arresting device 1, when a single or, sector wise all penetrated, hollow section 15 are removed and replaced with new hollow sections 15

The front edge of the partition walls further comprises a V-shaped profile 12 of ballistic material. The V-shaped profile is provided with a tip 12*a* towards the shooter to deflect projectiles from a path parallel to the partition walls 9 and guide the projectiles to the stopping material. The V-shaped profile 12 is dimensioned to maintain the mechanical integrity of the projectile arresting device which means that the partition walls 9 may comprise hollow sections 15 of the same kind as that of the pressure resistant wall 19. Furthermore, when assembling, preferably indoors, the V-shaped profile 12 can be arranged between the existing floor and ceiling or between the existing ceiling and the concrete foundation.

The V-shaped profile 12 may further comprise a wing 16 arranged to the steel profile tip 12*a* and directed towards the shooter. At least one profile 17 of polymeric material may further be provided to this wing 16. The polymeric profile serves to facilitate assembly of the pressure resistant wall.

Figure 2:
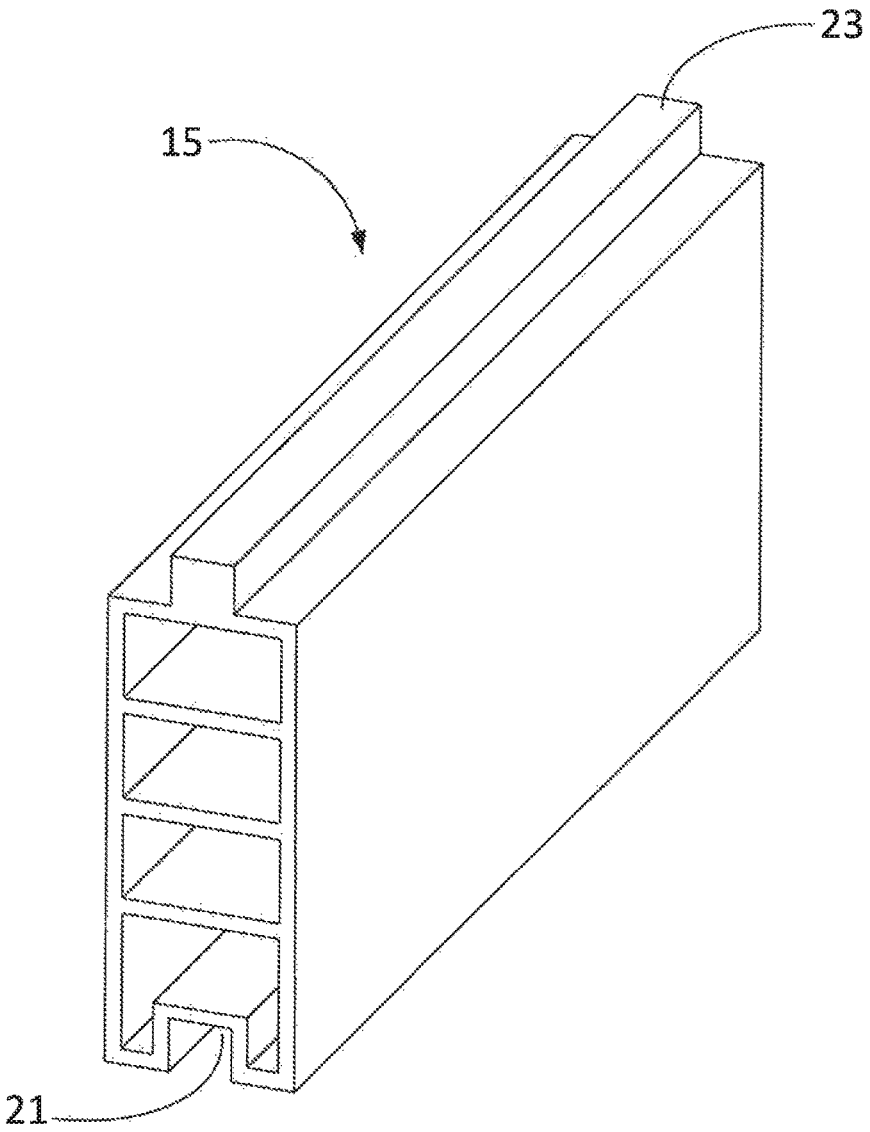
FIG. 2 shows a perspective view of a hollow section.

The hollow sections 15 are preferably made of a polymeric material or a reinforced polymeric material, but may in principle be made of any rigid material that withstands the load from stopping material 11 and which can be penetrated by projectiles. FIG. 2 shows a perspective view of a hollow section 15.

The hollow sections 15 preferably comprise a longitudinal plate-shaped geometry. The hollow sections further comprise an internal structure divided into cells, surrounded by the outer walls. The hollow sections 15 can be provided with a groove 21 and a tongue 23 which serves to connect the vertical hollow sections 15 to each other and to prevent openings. The hollow sections 15 can have a cross sectional length of 30-150 mm and a cross section width of 100-400 mm. Preferably, the hollow sections 15 have a cross sectional length of about 35-80 mm and a cross section width of 115-175 mm. The hollow sections 15 may have a thickness of 2-15 mm, and more preferably of 3-5 mm. The hollow sections 15 may also be provided with internal stiffening walls or flanges (not shown). The profiles can also be of two or several elements of the same material or in combination of two or more materials. The cavity of the sections can also be filled with penetrable material for stiffening purposes.

The projectile arresting device 1 may be provided with a moisture barrier layer 41 of polymeric material. This layer 41 prevents water from the soil to be absorbed by the stopping material 11. The moisture barrier layer 41 also prevents rainwater that has entered the projectile arresting module 1 from leaking into the ground. This prevents unwanted lead and other contaminants from projectiles or stopping material from being leached by water and spread in an uncontrolled manner in the surrounding environment. The layer 41 is applied on the foundation 3, and can also cover a lower part of an inner side of the rear wall 5. Rain water may be collected in a perforated drainage pipe disposed in the lower part of the projectile arresting device 1. The drainage pipe may be provided with a coupling 43 coupled to the next module or with a sleeve coupling (not shown) arranged in the layer 41. Another solid pipe, leading to a collection vessel or filter, may be coupled to sleeve coupling (not shown).

The projectile arresting device comprises a roof 33 projecting from the rear wall and which covers an area in front of the projectile arresting device. The roof may be a one piece integral part of the foundation 3, as a unit constituting the floor 7, rear wall 5 and the roof 33, all made of concrete. According to one embodiment, the roof 33 may include a roof top layer 35 made of ballistic steel plates. Further, the roof may include a roof bottom layer 37 made of a series of hollow sections 15. The hollow sections 15 can be the same as the hollow sections forming the front, pressure resistant wall 19 and they are suitably mounted in a similar manner. The roof is preferably connected to the foundation 3 and the partition walls. A misdirected projectile striking the roof bottom layer 37 with hollow sections 15 will penetrate a hollow section and expand against the ballistic plate 35. Because of the enlarged size of the projectile, they will be trapped in the space 39, without being able to bounce back through the entrance hole. The space 39 can also be filled with e.g. a stopping and/or absorbent material. The roof 33 may protrude from the rear wall 5, and cover an area in front projectile arresting device 1. The object of the roof 33 is to protect the projectile arresting device 1 and to prevent misdirected shots to pass over the projectile arresting device 1 out to the surroundings. The roof may further comprise a manhole cover.

It is possible to perform maintenance and installation work inside the projectile arresting device through the manhole M mentioned above, i.e., in the space limited by the foundation 3, the partition was 9 and the pressure resistant wall 19. Stopping material 11 may also be added or removed from the space through the manhole M, in case the roof 33 is freely accessible from above and for instance not, comprises a ceiling of a building.

According to one embodiment, a surface layer may be arranged in front of the front surface of the pressure resistant wall 19 for target projections.

As described above, existing walls, floors and ceilings may be used for mounting the projectile arresting device or projectile arresting arrangement indoors. Existing walls and floors then acts like the foundation for the projectile arresting device or projectile arresting arrangement. In another embodiment, however, the projectile arresting device may be a movable modular unit comprising a foundation constituting a floor, a rear wall and a roof. In doing so, it is possible to provide a projectile arresting arrangement comprising at least two projectile arresting devices 1, where at least two projectile arresting devices are grouped together, thereby forming an I-shape, L-shape, U-shape, C-shape, F-shape, T-shape or E-shape.

Figure 3A:
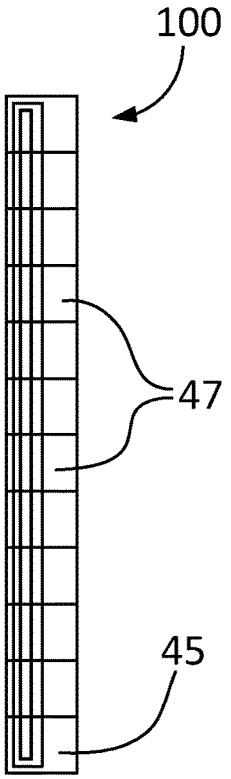
FIG. 3A shows a perspective view of an I-shaped projectile arresting arrangement according to an embodiment of the present invention.

FIG. 3A shows a perspective view of an I-shaped projectile arresting arrangement 100 according to an embodiment of the present invention. Several projectile arresting devices 1 are arranged in a line next to each other, thereby forming an I-shaped projectile arresting arrangement.

The projectile arresting arrangement 100 comprises end structures 45 and intermediate projectile arresting structures 47. The end structures 45 according to this embodiment each have a rectangular foundation 3 forming an end corner. The projectile arresting arrangement 100 shown in FIG. 7 comprises ten intermediate projectile arresting structures 47 and two end structures 45.

Figure 3B:
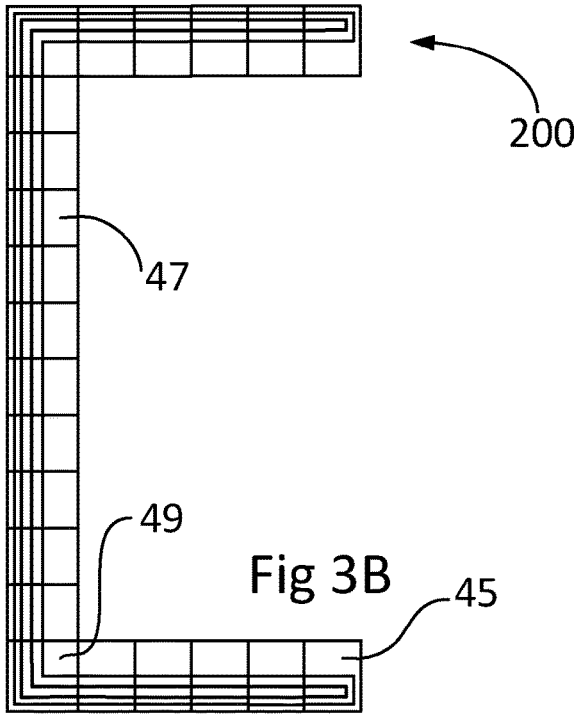
FIG. 3B shows a perspective view of a U-shaped projectile arresting arrangement according to an embodiment of the present invention.
Figure 3C:
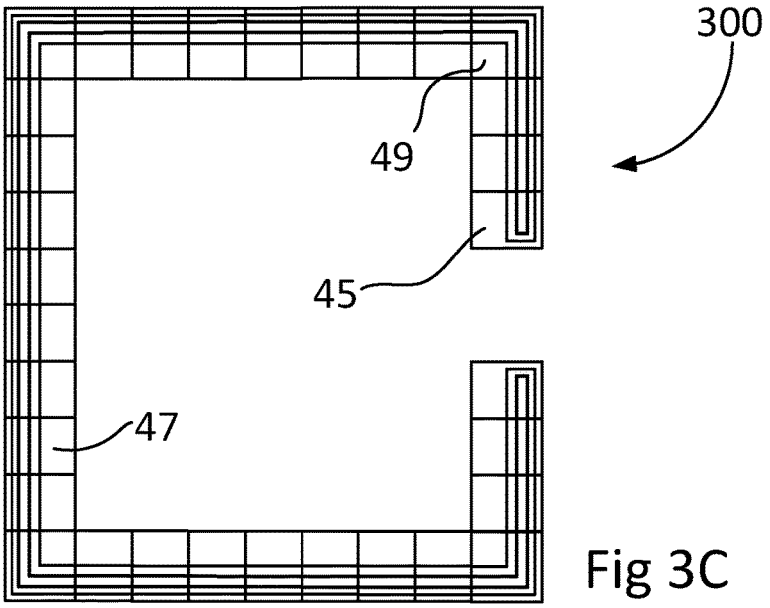
FIG. 3C shows a perspective view of a C-shaped projectile arresting arrangement according to an embodiment of the present invention.

The projectile arresting devices 1 may also be grouped together to form an L-shaped, U-shaped or C-shaped projectile arresting arrangement 200 and 300 (see FIGS. 3B and 3C). The end structures 45 according to this embodiment have a rectangular foundation 3. The projectile arresting arrangement 200, 300 according to these embodiments also comprises corner structures 49. The corner structures 49 have a rectangular foundation 3 forming the corner of the projectile arresting arrangement 200, 300.

Additional shapes of the projectile arresting arrangement 100, 200, 300 may be obtained by the positioning of the projectile arresting devices in relation to each other, such as e.g. E-shape, F-shape or T-shape.

It is not necessary to provide the end structures 45 with a rectangular foundation 3. In principle, end structures 45 may have a structure that is similar to the intermediate projectile arresting structures 47.

According to a further embodiment the projectile arresting device 1 is turned around. This means that the foundation 3, instead of having a shape of an standing L with a front side and a back side, has the shape of an inverted T with two front sides and no rear side. The projectile arresting device 1 is symmetrical about the rear wall 5 of the foundation 3. This embodiment has the advantage that the projectile arresting devices 1 may be grouped in room systems where firing can be performed on both sides of the respective projectile arresting devices 1.

The present invention is of course no in any way limited to the above described preferred embodiments, but many possibilities of modifications, or combinations of the described embodiments thereof, should be obvious to a person of ordinary skill in the art without departing from the basic idea of the invention as defined in the appended claims.

The invention claimed is:

1. A projectile arresting device comprising:

a foundation constituting a floor and a rear wall of the projectile arresting device, partition walls extending in a direction substantially perpendicular to the rear wall, the partition walls comprising a rear edge, arranged to the foundation, and a front edge, stopping material arranged between the partition walls, a stopping material retaining layer (S) disposed between the partition walls, and a pressure resistant wall comprising a number of closely situated hollow sections connected to the front edges of the partition walls, the pressure resistant wall further comprising a rear surface coupled to the stopping material retaining layer (S) and a front surface, the front edge of the partition walls comprising a V-shaped profile of ballistic material, wherein a tip of the profile is adjacent to the pressure resistant wall.

2. The projectile arresting device according to claim 1, wherein the tip of the profile further comprises a wing.

3. The projectile arresting device according to claim 2, wherein at least one profile of polymeric material is provided to the wing of the profile and further is connected to the pressure resistant wall.

4. The projectile arresting device according to claim 1, wherein the hollow sections are provided with a groove and a tongue to connect the hollow sections to each other.

5. The projectile arresting device according to claim 1, wherein the hollow sections are made of a polymeric material or a reinforced polymeric material.

6. The projectile arresting device according to claim 1, wherein the projectile arresting device comprises a roof projecting from the rear wall and covers an area in front of the projectile arresting device.

7. The projectile arresting device according to claim 6, wherein the roof is connected to the foundation and the partition walls.

8. The projectile arresting device according to claim 6, wherein the roof comprises a manhole (M).

9. The projectile arresting device according to claim 1, wherein a moisture barrier layer is arranged between the foundation and the stopping material.

10. The projectile arresting device according to claim 9, further comprising at least one drainage pipe disposed in connection with the moisture barrier layer.

11. The projectile arresting device according to claim 1, wherein a surface layer is arranged in front of the front surface of the pressure resistant wall for target projections.

12. The projectile arresting device according to claim 1, wherein the projectile arresting device comprises a movable modular unit comprising a foundation constituting a floor, a rear wall and a roof.

13. A projectile arresting arrangement comprising at least two projectile arresting devices according to claim 12, wherein at least two projectile arresting devices are grouped together, thereby forming an I-shape, L-shape, U-shape, C-shape, F-shape, T-shape or E-shape.

14. The projectile arresting device according to claim 7, wherein the roof comprises a manhole (M).

* * * * *